US005472776A

United States Patent [19]

Gallagher et al.

[11] Patent Number: 5,472,776

[45] Date of Patent: Dec. 5, 1995

[54] CATALYZED ASPHALT BINDER FOR GLASS FIBERS

[75] Inventors: Kevin P. Gallagher, Pataskala; Donn R. Vermilion, Newark, both of Ohio

[73] Assignee: Owens-Corning Fiberglas Technology Inc., Summit, Ill.

[21] Appl. No.: 363,171

[22] Filed: Dec. 23, 1994

[51] Int. Cl.[6] ..... D04H 1/58

[52] U.S. Cl. ..... 428/288; 428/291; 428/328; 428/440; 428/489; 428/920

[58] Field of Search ..... 428/291, 328, 428/440, 489, 288, 920

[56] References Cited

U.S. PATENT DOCUMENTS 2,701,777 2/1955 Farris .
2,712,506 7/1955 Farris .
2,771,387 11/1957 Kleist et al. .
2,811,769 11/1957 Craig .
3,440,195 4/1969 Norcross .
4,166,752 9/1979 Marzocchi et al. .
4,175,978 11/1979 Marzocchi et al. .
4,186,236 1/1980 Heitmann .
4,211,575 7/1980 Burris .
4,225,353 9/1980 Beaudoin et al. .
4,285,734 8/1981 Marzocchi et al. .
4,349,590 9/1982 Bolen et al. .
4,381,200 4/1983 Bolen et al. .

*Primary Examiner*—James J. Bell
*Attorney, Agent, or Firm*—C. Michael Gegenheimer; Patrick P. Pacella

[57] ABSTRACT

Glass fibers are coated with an asphalt emulsion wherein the coating is catalyzed with a Friedel-Craft catalyst. The preferred catalyst is ferric chloride. The coated glass fibers are especially useful as thermal insulation.

12 Claims, No Drawings

CATALYZED ASPHALT BINDER FOR GLASS FIBERS

TECHNICAL FIELD

This invention relates to glass fibers coated with catalyzed asphalt. The coated glass fibers are useful for thermal insulation.

BACKGROUND ART

Acoustical and thermal insulating fibrous glass products have been manufactured for many years. The manufacturing typically involves a process which comprises attenuating the fibers with a rotary device to produce a downwardly falling stream of fibers. During their downward flow, a binder is sprayed onto the glass fibers and the sprayed fibers are collected on a conveyor in the form of a blanket. This blanket is then heated to bind the fibers. Typically, in the past, the binders were thermoset resins such as phenolic resins.

A later development in forming acoustical or thermal insulating glass fiber products is using an asphalt emulsion as the binder. Heating the asphalt coverts the asphalt to an insolubilized form and binds the fibers. An excellent bond results without the use of thermoset resins.

One of the big drawbacks to the use of asphalt as a binder on fiberglass is the cure time required to achieve a high modulus thermoset. The cure of an asphalt based binder is slow in comparison to typical phenolic binders requiring an order of magnitude more time to achieve the same state of cure as measured by recovery of a compressed wool pack.

DISCLOSURE OF INVENTION

We have discovered glass fibers coated with an asphalt wherein the asphalt is catalyzed with a Friedel-Crafts catalyst. The use of a catalyst greatly reduces the time necessary for curing the asphalt. The preferred catalyst is ferric chloride. Through the use of a catalyst such as a metallic halide, the asphalt can be cured nearly as fast as the phenolic binder. For example, the cure time required for asphalt based binder was reduced from 30 minutes to 10 minutes at 275° C. using ferric chloride $FeCl_3$ catalyst. The coated glass fibers are especially useful as thermal insulation.

BEST MODE OF CARRYING OUT INVENTION

The practical application of an asphalt binder to glass is through application of an emulsion of the asphalt. Ferric chloride is very acidic which means the emulsion must be stable at low pH. For this purpose, cationic emulsifiers are used. The amount is not critical. The ranges used are based on practical process conditions for stable asphalt emulsions. The pH of the final emulsion is in the 2–5 range.

Ferric chloride can be dissolved in water to form a dilute solution and added to the emulsion with agitation. The preferred method of incorporation is to blend the ferric chloride into the asphalt prior to emulsification. The amount of ferric chloride used can range from 0.05 percent to 1.0 percent based on the weight of the asphalt. The preferred amount is 0.4 percent to 0.7 percent.

While we prefer ferric chloride ($FeCl_3$) as the catalyst, generally we employ a Friedel-Crafts catalyst. Friedel-Crafts catalysts include Lewis acids, protonic acids and zeolites.

The term "Lewis acid" is used herein in accordance with its commonly accepted meaning in the chemical field, i.e. a molecule or ion which combines with a second molecule or ion by forming a covalent bond with two electrons from the latter. Preferred Lewis acids are metal halide-type Lewis acids, which have an electron-deficient central metal atom capable of electron acceptance. Among these are halides of aluminum, berylium, cadmium, zinc, boron, gallium, titanium, zirconium, tin, antimony, bismuth, iron and uranium are preferred. The preferred halides are chlorides and bromides. Combinations of species are also included within the scope of the invention. Particularly preferred Lewis acids are aluminum and ferric halides, particularly aluminum and ferric chlorides ($AlCl_3$ and $FeCl_3$).

Protonic acids include oxyacids such as sulfuric acid and paratoluenesulfonic acid. Natural zeolite is a hydrated silicate of aluminum and either sodium or calcium or both. Natural zeolite has the formula $Na_2O.Al_2O_3.nSiO_2.XH_2O$.

We apply the asphalt in the form of an aqueous emulsion using equipment that had been employed in the past to directly spray a binder onto a downwardly flowing stream of glass fibers. These fibers are then collected, as in the past, in the form of a blanket on a conveyor, and are heated at a temperature and for a time sufficient to remove water.

The term asphalt means asphalts which are free of rubber and are non-chemically modified. That is, they are conventional asphalts, not asphalts which have been combined with rubber or reacted with asphalt reactive materials. Preferably, the asphalts for use herein are the air blown asphalts, as well as asphalt flux or paving grade asphalts known as asphalt cements. Representative asphalts are AC-20, AC-10 and AC-5. Such asphalts are most desirably applied as an aqueous emulsion and the emulsion may be produced by techniques well known in the art. More conveniently, however, any of the numerous commercially available emulsions will be employed. Such emulsions are exemplified by those commercially available from the Koppers Chemical Company under their designation CRS-1 emulsion is that available from Byerlite under their designation K-1-C. The emulsions employed in the practice of this invention may be either anionic, cationic or nonionic. As will be readily apparent, such emulsions will include the dispersed asphalt, water and an appropriate emulsifying agent.

Suitably, the emulsions which are applied will contain about 20 percent to about 98.5 (by weight) water. For insulation uses, the asphalt content of the emulsion will be about 1 percent to about 40.0 percent. The remainder of the asphalt emulsion will include an emulsifying agent, for example, a cationic, anionic or nonionic surfactant present in an amount sufficient to emulsifying the asphalt and preferably a lubricant. The lubricant will desirably be present in an amount of about 0.05 percent of about 1.0 percent (based on the weight of emulsion). Generally, the non-aqueous portion of the emulsion will contain about 1 percent to about 10 percent of the above-described materials. Usually the emulsion will be applied in sufficient amounts so that the final product will contain about 1 to about 50 percent by weight of asphalt (based on the total weight of asphalt and glass). Preferably, the weight percent of asphalt ranges from 5 to 20 percent by weight for insulation uses.

After application of the asphalt emulsion to the stream of fibers, the fibers are collected as a blanket on a conveyor. The blanket then is extracted under a vacuum and dried at elevated temperatures typically at temperatures between 50°–100° C. for a period of time typically up to 24 hours.

EXAMPLE I

Glass fiber wool samples were coated with asphalt using a flood and extract method with asphalt emulsion made from AC 10. Some of the samples were coated with asphalt emulsion that included ferric chloride. Other samples did not contain the catalyst. The pH of the emulsions was adjusted to 4.5 with hydrochloric acid. The flooded samples were extracted under a vacuum of 35 inches water for about 30 seconds to remove excess emulsion.

| Sample | 0% $FeCl_3$ | 0.6% $FeCl_3$ |
|---|---|---|
| glass wt. (g) | 131.7 | 130.9 |
| emul. solids (%) | 7 | 7.0 |
| emul. weight | excess | excess |
| glass + dried asphalt wt. (g) | 167.7 | 163 |
| % asphalt | 21 | 20 |

The samples were than dried at 150° F. for 24 hours. The dried samples contained about 20% asphalt by weight. 12"×12" samples were cured for 10 minutes at a temperature of 275° C. to a density of 0.6 to 0.7 pcf.

EXAMPLE II

The samples prepared in Example I were compressed to 12 pounds per cubic foot for 16 hours at room temperature. Two samples containing the ferric chloride catalyst recovered to an average of 83% of their original height. Two samples without the ferric chloride recovered to an average of only 50%. Conventional glass fiber wool insulation with a phenolic binder typically has a recovery above 80%.

EXAMPLE III

The percent recovery of the four samples referred to in Example II was remeasured after the samples were dropped two times from a height of about 3 feet. Recovery for these samples was consistent with the samples of Example II. That is, the samples with the ferric chloride catalyst recovered 93% and the samples without the catalyst only recover to 62%.

We claim:

1. Glass fibers having a coating thereon wherein the coating is a catalyzed asphalt wherein the asphalt is catalyzed with a Friedel-Crafts catalyst.

2. Glass fibers according to claim 1 wherein the coating is dried residue from a Friedel-Crafts catalyzed asphalt emulsion.

3. Glass fibers according to claim 1 wherein the Friedel-Crafts catalyst is a Lewis acid.

4. Glass fibers according to claim 1 wherein the Friedel-Crafts catalyst is a metallic halide.

5. Glass fibers according to claim 1 wherein the Friedel-Crafts catalyst is ferric chloride.

6. Glass fibers according to claim 1 wherein the coated glass fibers contain 1 to 50 percent by weight of asphalt based on the total weight of asphalt and glass fibers.

7. Glass fibers according to claim 1 wherein the coated glass fibers contain 5 to 20 percent by weight of asphalt based on the total weight of the asphalt and glass fibers.

8. Glass fibers according to claim 2 wherein the asphalt emulsion has an asphalt content ranging from 1 to 50 percent by weight.

9. Glass fibers according to claim 2 wherein the asphalt emulsion has an asphalt content ranging from 5 to 20 percent by weight.

10. Glass fibers according to claim 2 wherein the asphalt emulsion has a catalyst content ranging from 0.05 to 1.0 percent by weight.

11. Glass fibers according to claim 3 wherein the asphalt emulsion has a catalyst content ranging from 0.4 to 0.7 percent by weight.

12. Thermal insulation comprising the coated glass fibers of claim 1.

* * * * *